US005877575A

United States Patent [19]

Nara et al.

[11] Patent Number: 5,877,575

[45] Date of Patent: Mar. 2, 1999

[54] STARTER FOR AN INTERNAL COMBUSTION ENGINE

[75] Inventors: Koji Nara, Maebashi; Masaaki Ohya, Isesaki; Yoshikazu Sato, Fukaya; Michio Okada, Gunma; Shinichi Nagashima, Ashikaga, all of Japan

[73] Assignee: Mitsuba Corporation, Gunma-ken, Japan

[21] Appl. No.: 47,034

[22] Filed: Mar. 24, 1998

[30] Foreign Application Priority Data

Mar. 24, 1997 [JP] Japan ..... 9-088962

[51] Int. Cl.[6] ..... H01R 39/38

[52] U.S. Cl. ..... 310/239; 310/83; 310/87; 310/88; 310/89; 310/238; 310/242; 290/38 A; 290/38 B; 290/48

[58] Field of Search ..... 310/238, 239, 310/242, 87, 88, 83, 89; 290/38 A, 38 B, 48

[56] References Cited

U.S. PATENT DOCUMENTS 5,619,082 4/1997 Choi ..... 310/88

FOREIGN PATENT DOCUMENTS 8-319926 12/1996 Japan .

*Primary Examiner*—Nestor Ramirez
*Assistant Examiner*—Thanh Lam
*Attorney, Agent, or Firm*—Marshall & Melhorn

[57] ABSTRACT

In a starter for an internal combustion engine, comprising: a pinion; shift mechanism for moving the pinion into mesh with a ring gear of the engine; a housing for accommodating the pinion and the shift mechanism; an electric motor for rotating the pinion; a substantially cylindrical motor casing for accommodating the electric motor; a contact unit for selectively providing electric power to the electric motor; a brush holder stay disposed between the housing and the motor casing, the brush holder stay having a cavity opened toward the motor casing and the contact unit being mounted in the cavity; and a cover for covering the cavity of the brush holder stay, the cover is made of a flexible member so that the cover is naturally curved, and the cover is disposed between the brush holder stay and the motor casing with its concave surface facing the brush holder stay so that the cover is pushed toward the brush holder stay by an axial end of the motor casing. Thus, when pressed against the brush holder stay by the motor casing, the cover is deformed and made straight to produce a resilient restoring force, whereby increasing the pressing force to ensure sufficient watertight sealing effect.

11 Claims, 4 Drawing Sheets

STARTER FOR AN INTERNAL COMBUSTION ENGINE

TECHNICAL FIELD

The present invention relates to a starter for an internal combustion engine, particularly to an engine starter having a watertight sealing structure.

BACKGROUND OF THE INVENTION

Conventionally, a starter for starting an internal combustion engine typically comprises a motor, a one-way clutch connected to the motor and driven by the same via a reduction gear unit consisting of a planetary gear device or the like, a pinion gear connected to the one-way clutch, a solenoid for displacing the pinion gear via a shift mechanism in response to an engine start switch signal so that the pinion gear meshes with a ring gear of the engine, and others.

To minimize total size of the starter, a coaxial engine starter in which the aforementioned component parts are arranged coaxially has been proposed for example in Japanese Patent Application Laid Open Publication No.8-319926 filed by the Applicant (Assignee) of this application. In this engine starter, the solenoid is disposed around the starter's output shaft and accommodated in a shift chamber housing which also accommodates the pinion gear, shift mechanism, reduction gear unit and others, while the electric motor is accommodated in a substantially cylindrical motor casing. Between the shift chamber housing and the motor casing is disposed a brush holder stay which can be made of resin material by molding.

A terminal for connection to an outside power supply (typically a battery) is favorably mounted to the brush holder stay. The power supply terminal projects radially outwardly with respect to the motor casing and the brush holder stay is formed with a corresponding radially protruding portion to support the terminal. A contact unit for selectively supplying electric power to the motor is also favorably mounted to the brush holder stay near the power supply terminal. The brush holder stay may be formed with a cavity for mounting the contact unit therein, with the cavity opened toward the motor casing for the reasons such as convenience in mounting the contact unit therein and/or easiness in molding the brush holder stay. In the assembled state of the starter the cavity must be covered so as to prevent water and/or dust from entering it, but the cavity typically extends to the protruding portion and cannot be covered by the motor casing. Therefore, a rubber cover, for example, is used to close the cavity in such a manner that the cover is pushed in the axial direction against the brush holder stay by the motor casing in order to achieve watertight engagement between the cover and the brush holder stay.

However, the axial force applied to the cover by the motor casing may not work effectively to press the peripheral part of the cover against the brush holder stay, and therefore it has been difficult to reliably achieve watertight contact between the brush holder stay and the cover for covering the cavity of the brush holder stay.

BRIEF SUMMARY OF THE INVENTION

In view of such problems of the prior art, a primary object of the present invention is to provide a starter for an internal combustion engine, which comprises a reliable watertight sealing structure for closing a cavity formed in the brush holder stay.

A second object of the present invention is to provide such an engine starter comprising a reliable watertight sealing structure with reduced manufacturing cost.

According to the present invention, these and other objects can be accomplished by providing a starter for an internal combustion engine, comprising: a pinion; shift means for moving the pinion into mesh with a ring gear of the engine; a housing for accommodating the pinion and the shift means; an electric motor for rotating the pinion; a substantially cylindrical motor casing for accommodating the electric motor; a contact unit for selectively providing electric power to the electric motor; a brush holder stay disposed between the housing and the motor casing, the brush holder stay having a cavity opened toward the motor casing and the contact unit being mounted in the cavity; and a cover for covering the cavity of the brush holder stay, the cover being made of a flexible member so that the cover is naturally curved, wherein the cover is disposed between the brush holder stay and the motor casing with its concave surface facing the brush holder stay so as to be pushed against the brush holder stay by an axial end of the motor casing.

Thus, when pressed against the brush holder stay by the motor casing, the cover is deformed and made straight to produce a resilient restoring force, whereby increasing the pressing force to ensure sufficient watertight sealing effect. This can tolerate less precision in making the cover and/or other component parts and therefore can lead to a reduced manufacturing cost.

Preferably, the cover for covering the cavity is provided with an axial protrusion on its surface facing the brush holder stay so that an outer peripheral surface of the axial protrusion of the cover closely faces the inner peripheral surface of the cavity. In this way, a radial force produced by the straightening action of the cover causes the outer peripheral surface of the axial protrusion of the cover to be pressed against the inner peripheral surface of the cavity in the radial direction. Therefore, the cover and the brush holder stay tightly engage each other not only in the axial direction but also in the radial direction so that tighter contact therebetween can be achieved. It will be more preferable to enhance the radial engagement between the cover and the brush holder stay if the outer peripheral surface of the axial protrusion of the cover is provided with a ridge projecting toward the inner peripheral surface of the cavity. Alternatively or in addition, the ridge may be provided on the inner peripheral surface of the cavity. Further preferably, a stepped portion is formed along a brim of the cavity and an end surface of the axial protrusion of the cover has a shape complementary to the stepped portion. Even without the axial protrusion, it may be advantageous to shape the cover such that when attached to the brush holder stay, it abuts a shoulder surface of the stepped portion and its outer peripheral surface closely faces an inner peripheral surface of the stepped portion. In this case also, the radial force produced by the straightening action of the cover works to achieve an enhanced radial engagement between the cover and the brush holder stay.

In view of protecting the contact unit mounted in the cavity, it is preferable if the cover is provided on its surface facing the brush holder stay with at least one axially projecting walls for protecting the contact unit. In a preferred embodiment of the present invention, said at least one axially projecting walls of the cover consist of upper and lower projecting walls extending on upper and lower sides of the contact unit in an assembled state.

In view of ensuring tight contact between the motor casing and cover, it is preferable if a surface of the cover which is pushed by the motor casing is formed with an arcuate recess adapted for receiving the axial end of the motor casing. It is more preferable if a bottom of the arcuate recess of the cover is provided with a ridge projecting toward the motor casing.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
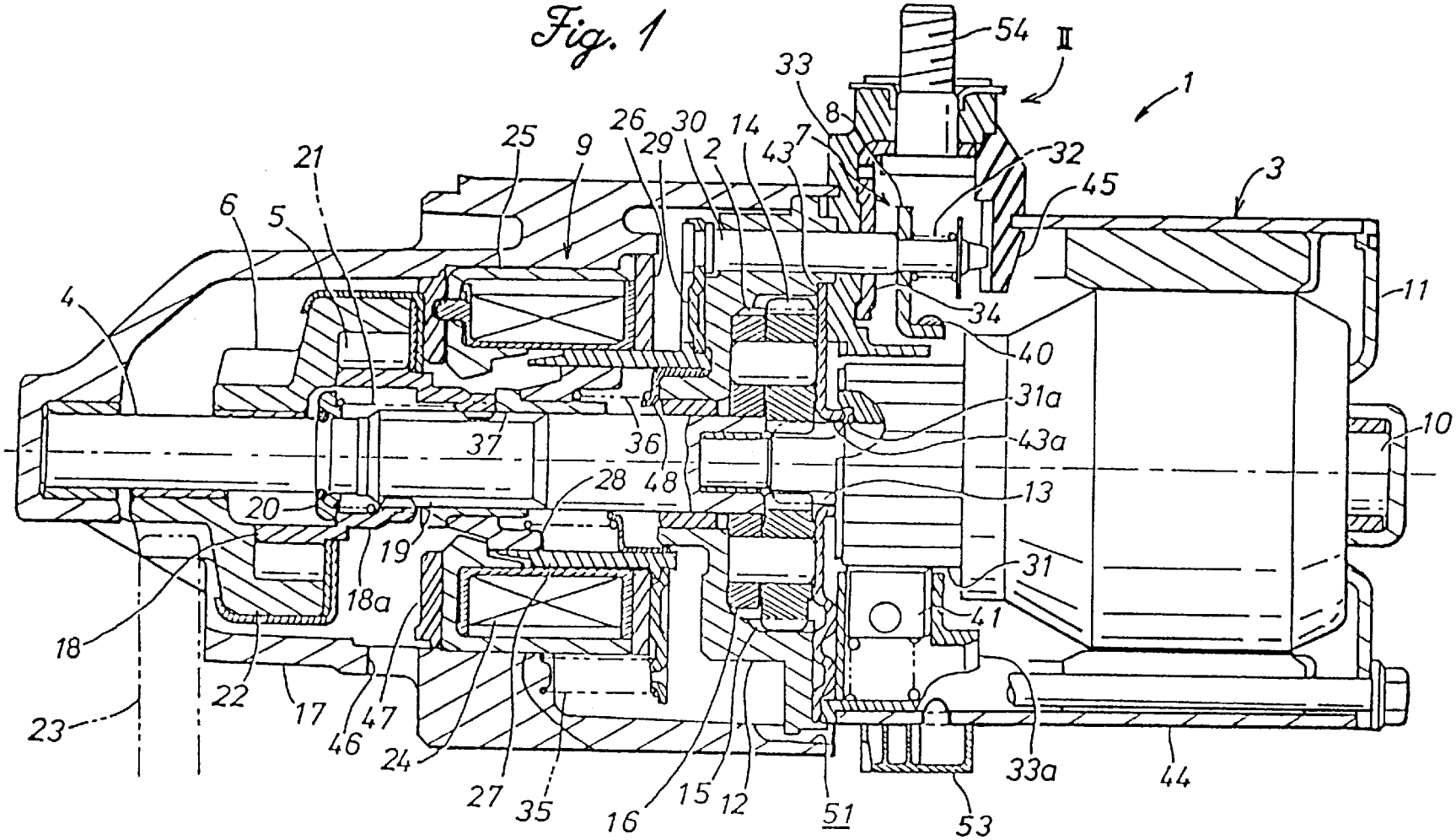
FIG. 1 is an overall view of an engine starter configured according to the present invention.

FIG. 1 generally illustrates an engine starter constructed according to the present invention, where the engine starter is equipped with a reduction gear unit. The upper half of the drawing illustrates the starter at its inoperative state while the lower half of the drawing illustrates the starter at its operative state. It should be noted that in FIG. 1 the component parts are shown in their respective cross sections selected in view of clearer explanation, and therefore these cross sections are not necessarily in the same plane. This starter 1 produces a torque which is necessary for starting an internal combustion engine, and comprises an electric motor 3 equipped with a planetary gear reduction gear unit 2, an output shaft 4 connected to the electric motor 3 via the reduction gear unit 2, a one-way roller clutch 5 and a pinion 6 which are slidably mounted on the output shaft 4, a switch unit 7 for selectively opening and closing the electric power line leading to the electric motor 3, and a solenoid device 9 for axially moving a moveable contact plate 8 of the switch unit 7 as well as the pinion 6.

The electric motor 3 consists of a known commutator type DC electric motor, and its rotor shaft 10 is pivotally supported at a center of a bottom plate 11 at its right end as seen in the drawing, and pivotally supported at a center of a right end of the output shaft 4, which is coaxially disposed with respect to the rotor shaft 10, at its left end (on the side of the ring gear 23 of the engine) as seen in the drawing.

The reduction gear unit 2 comprises a sun gear 13 which is formed in a part of the rotor shaft 10 adjacent to the output shaft 4, a plurality of planetary gears 14 meshing with the sun gear 13, and an internal teeth ring gear 15 to mesh with the planetary gears 14. In this starter 1, the internal teeth ring gear 15 is formed along the inner periphery of a top plate 12 so that the top plate 12 is used as a ring gear member. A support plate 16 supporting the planetary gears 14 is attached to the right end of the output shaft 4 (on the side of the electric motor 3) which is pivotally supported at the center of the top plate 12.

To the top plate 12 is attached a pinion housing 17 which also serves as a securing bracket for mounting the starter to the engine. The left end of the output shaft 4 is pivotally supported by a central part of the inner surface of the left wall of the pinion housing 17. As seen in the drawing, the left side part of the pinion housing 17 constitutes a chamber for accommodating the pinion 6, and the right side part of the pinion housing 17 forms a shift chamber casing.

The outer circumferential surface of a middle part of the output shaft 4 is provided with a helical spline 19, and an axial end portion of a sleeve 18*a* of a clutch inner member 18 of the one-way roller clutch 5 engages the helical spline 19. The clutch inner member 18 is normally urged to the right (the retracting direction) by a second return spring 21 interposed between the sleeve 18*a* and a stopper plate 20 secured to a left end portion of the output shaft 4. The second return spring 21 is received in an annular gap defined between the inner circumferential surface of the sleeve 18*a* of the clutch inner member 18 and the outer circumferential surface of the output shaft 4.

The tubular clutch inner member 18 engages a clutch outer member 22 of the one-way roller clutch 5 in an axially fast but rotationally free relationship. The clutch outer member 22 is provided with a tapered surface for defining a wedge chamber of the one-way roller clutch 5, and a part of the clutch outer member 22 adjacent to the ring gear 23 is provided with a projection directed to the end wall and the ring gear 23. The outer peripheral part of the projection is integrally formed with the aforementioned pinion 6 which meshes with the ring gear 23 of the engine to drive the same. The clutch outer member 22 integrally formed with the pinion 6 is fitted on the left end of the output shaft 4 in a both rotationally and axially free relationship.

In an intermediate part of the pinion housing 17 is secured an energization coil 24 which surrounds the output shaft 4 made of nonmagnetic material. The energization coil 24 is surrounded by a yoke defined by a cup-shaped holder 25 through which the output shaft 4 is passed and an annular disk 26. In a gap defined between the inner circumferential surface of the energization coil 24 and the outer circumferential surface of the output shaft 4 is disposed an armature outer member 27 serving as a first plunger and an armature inner member 28 serving as a second plunger, both made of ferromagnetic material, in a mutually coaxial and axially slidable, telescopic manner. The left ends of the armature members 27 and 28 (the ends facing the pinion 6) oppose a projecting boss formed on the inner peripheral part of the holder 25 as a magnetic pole for the armatures 27 and 28.

An annular connecting plate 29 is fitted around the outer periphery of the right end of the armature outer member 27, and a connecting rod 30 which projects axially from an outer peripheral part of the connecting plate 29 is passed through the top plate 12 of the electric motor 3. To the projecting end of the connecting rod 30 is attached the moveable contact plate 8 of the switch unit 7 provided near a commutator 31 of the electric motor 3. The moveable contact plate 8 is mounted on the connecting rod 30 in an axially moveable manner, and is floatingly supported by a coil spring 32.

In this embodiment, four brush holders 33*a* are disposed around the commutator 31. These brush holders 33*a* are each integrally formed in a brush holder stay 33 which is made of synthetic resin material and securely mounted between the motor casing 44 and the pinion housing 17. A fixed contact plate 34 of the switch unit 7 is secured to the brush holder stay 33, and the aforementioned moveable contact plate 8 is provided such that it can be engaged and disengaged with and from the fixed contact plate 34.

The armature outer member 27 is always urged to the right by a first return spring 35 interposed between the connecting plate 29 and the inner wall of the pinion housing 17, but is normally at its neutral position separating the moveable and fixed contact plates from each other (in the state shown in the upper half of the drawing).

The armature inner member 28 is urged to the left in the drawing or toward the ring gear 23 by a coil spring 36 which is interposed between the armature inner member 28 and a spring retainer 48 made of non-magnetic material as spring means. The spring retainer 48 is fitted into a part of the inner bore of the armature outer member 27 adjacent to the electric motor 3. The armature inner member 28 is attached to a shifter member 37 which is made of non-magnetic material and has a left end abutting the right end of clutch inner member 18. The spring force of the coil spring 36 is weaker than that of the second return spring 21 provided on the clutch inner member 18 under the rest condition of the pinion 6, but becomes greater than that of the second return spring 21 before it is fully compressed by the armature outer member 27 which moves ahead of the armature inner member 28.

The energization coil 24 is electrically connected to an ignition switch not shown in the drawing via a connector provided in the switch unit 7. The fixed contact plate 34 of the switch unit 7 is electrically connected to the positive terminal of a battery not shown in the drawings via a power supply terminal 54 which is described later, and a pair of pigtails 40 connected to a pair of positive pole brushes are attached to the movable contact plate 8 of the switch unit 7. A pair of negative pole brushes 41 are provided in a line-symmetrically opposing positions with respect to the positive pole brushes. The pigtails for these negative pole brushes 41 are connected to a center plate 43 which is described hereinafter, and are connected to the negative terminal of the battery via the pinion housing 17 and the vehicle body which is not shown in the drawings. The switch unit 7 is provided in a space flanked by the positive pole brushes.

The metallic annular center plate 43 is interposed between the brush holder stay 33 and the top plate 12 to separate the reduction gear unit 2 and the electric motor 3 from each other. From a central portion of the center plate 43 projects an annular boss 43*a* toward the commutator 31 so as to surround the outer periphery of the rotor shaft 10 defining a small gap therebetween. The free end of the annular boss 43*a* fits into a recess 31*a* formed in the axial end surface of the commutator 31 so as to prevent grease in the reduction gear unit 2 from leaking into the commutator 31.

The switch unit 7 is located in an upper portion of the starter 1, and the contact unit formed by the fixed contact plate 34 secured to the brush holder stay 33 and the moveable contact plate 8 is covered by the brush holder stay 33 and a cover 45 made of elastomer inside the motor casing 44 serving as a yoke. Thereby, brush dust is prevented from entering the contact unit of the switch unit 7.

The pinion housing 17 is provided with a drain hole 46 at a lower part thereof in the installed state of the starter 1. This drain hole 46 is provided near the seal plate 47 for determining the rest position of the pinion 6 as well as for repelling water. In the rest state of the starter the solenoid device 9 is sealed by the pinion 6 and seal plate 47 which are pressed against each other by the second return spring 21, but a space is created between the pinion 6 and the seal plate 47 once the pinion 6 has moved and meshed with the ring gear 23, and a gap between the outer peripheral surface of the clutch outer member 22 and the inner peripheral surface of the pinion housing 17 may permit intrusion of water. Even in such a case, the seal plate 47 works to block such water and removal of the water is favorably achieved by the provision of the drain hole 46 provided in front of the seal plate 47.

In the starter 1, in order to remove the water taken into a part of the pinion housing 17 which forms the shift chamber casing, a drain channel 51 is formed in an inner periphery of the opening of the pinion housing 17 adjacent to the motor 3 so that the drain channel 51 extends along the output shaft 4 or along the axis of the shift chamber casing at a lowermost part of the pinion housing 17 in the installed state of the starter. To a part of the motor casing 44 which is located at its underside in the starter's installed state and which is adjacent to the drain channel 51, is attached a drainage cap member 53 which is made of synthetic resin material by molding. It should be noted that although in FIG. 1 the brush holder 33*a* is shown at the lowermost position in the motor casing 44 for explanation, the brush holder 33*a* is actually placed at a position somewhat raised from the lowermost position in the state that the starter 1 is mounted to the engine.

Figure 2:
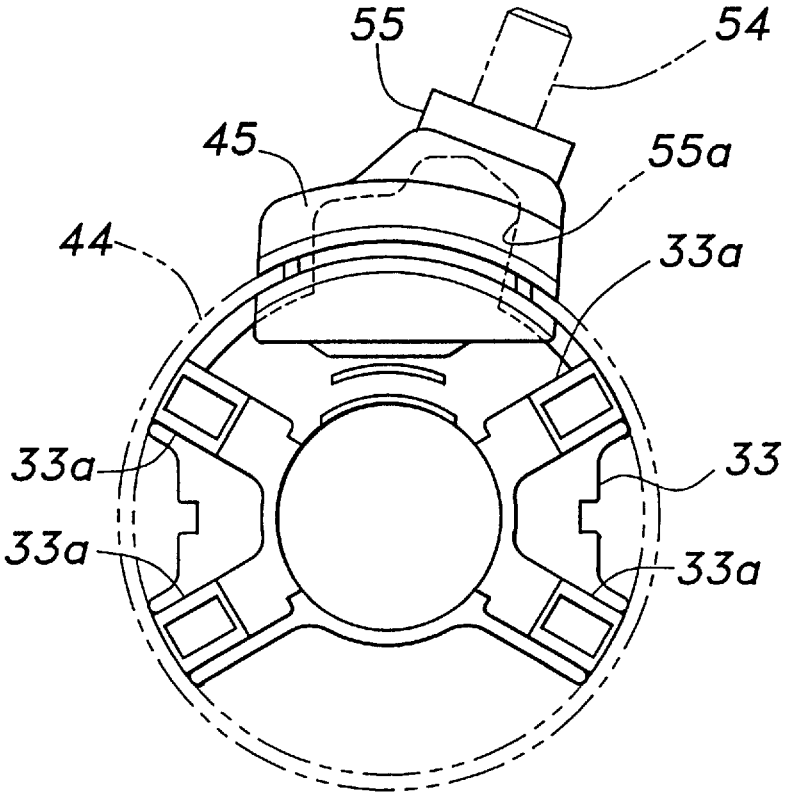
FIG. 2 is an end view of the brush holder stay and the cover seen in the direction indicated by the arrow II in FIG. 1.

FIG. 2 is an end view which shows the brush holder stay 33 and the cover 45 seen along the arrow II in FIG. 1, with the cover 45 shown in the attached state. As shown in FIGS. 1 and 2, the power supply terminal 54 of the starter 1 is provided on the upper side of the brush holder stay 33 in the assembled state in a manner that the terminal 54 projects in a radially outward direction. The brush holder stay 33 is integrally formed with a protruding portion 55 which extends in a radially outward direction to support the base portion of the power supply terminal 54.

The protruding portion 55 has a wall surrounding the base portion of the power supply terminal 54 as well as the contact unit so as to support the power supply terminal 54 and protect the contact unit and, in the illustrated brush holder stay 33, is formed with an open cavity 55*a* on its side facing the motor 3 in the assembled state. In order to cover the cavity 55*a*, the cover 45 which has substantially the same profile with that of the cavity 55*a* is attached to the protruding portion 55.

Figure 3:
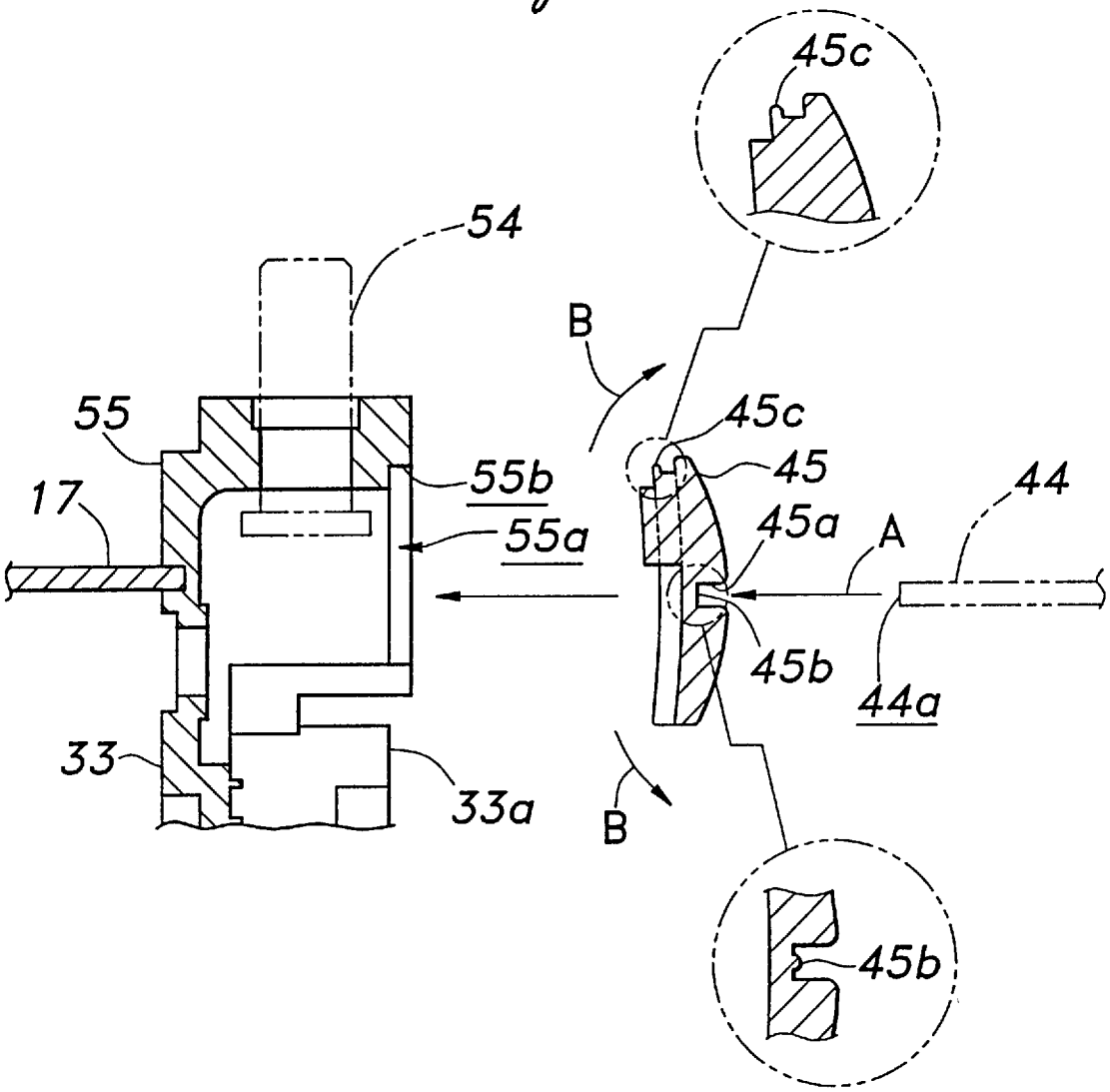
FIG. 3 is an exploded view for explaining the way the cover is assembled.

The cover 45 is pushed by the motor casing 44 in the direction indicated by the arrow A or in the axial direction as shown in FIG. 3, and thereby tightly attached to the brush holder stay 33. The cover 45 is provided with an arcuate recess 45*a* in a middle part of its outward end surface, the surface that is pushed by the motor casing 44, so that the axial end 44*a* of the motor casing 44 is fitted in the arcuate recess 45*a*.

As shown in FIG. 3, the cover 45 is formed so that it is naturally curved slightly. When attached to the brush holder stay, the cover 45 is aligned with the cavity 55*a* of the brush holder stay 33 with its concave side facing the cavity 55*a*, and then its convex side is pushed by an axial end 44*a* of the motor casing 44. Thus, when pressed against the brush holder stay 33 by the motor casing 44 in the direction indicated by the arrow A in FIG. 3, the cover 45 is deformed in the direction shown by the arrows B to become straight so that it tightly contacts a flat end surface around the cavity 55*a* in the protruding portion 55 of the brush holder stay 33.

In this way, the cover 45 can be brought into contact with the brush holder stay 33 with a greater pressing force due to its resilient restoring force. Therefore, even if the surface of the cover 45 is processed with low precision, the greater pressing force can ensure that the cover 45 demonstrates a sufficient watertight sealing effect. It should be noted that although the cover 45 was shown in the drawing as being naturally curved to have an arcuate cross section, it may have a cross section of ">" shape.

Further, as shown in FIG. 3, according to the present invention a ridge 45*b* is formed on the bottom of the arcuate recess 45*a* of the cover 45. The ridge 45*b* projects toward the motor casing 44 and abuts the axial end of the motor casing 44. Due to this narrow ridge 45*b*, the cover 45 and the motor casing 44 contact each other with an increased press force per unit of area, and thus tighter engagement therebetween can be achieved. As also shown in FIG. 3, the cover 45 can be formed with an axial protrusion which has an outer peripheral surface closely facing an inner peripheral surface of the cavity 55*a* and preferably has an axial section complementary to that of a stepped portion 55*b* formed along the brim of the cavity 55*a*. The outer peripheral surface of the axial protrusion of the cover 45 comes into tight contact with an inner peripheral surface of the stepped portion 55*b* due to a radial force produced when the cover 45 is pressed against the brush holder stay 33 and made straight. Preferably the outer peripheral surface of the axial protrusion of the cover 45 is also provided with a ridge 45*c* to enhance the radial engagement between the cover 45 and brush holder stay 33. The ridge may be provided on the inner peripheral surface of the cavity 55*a*. In this fashion, not only the axial force from the motor casing but also the radial force produced when the naturally curved cover 45 becomes straight can be effectively utilized to bring the cover 45 into tight contact with the brush holder stay 33, to whereby achieve reliable watertight sealing of the cavity 55*a* of the brush holder stay 33.

Figure 4:
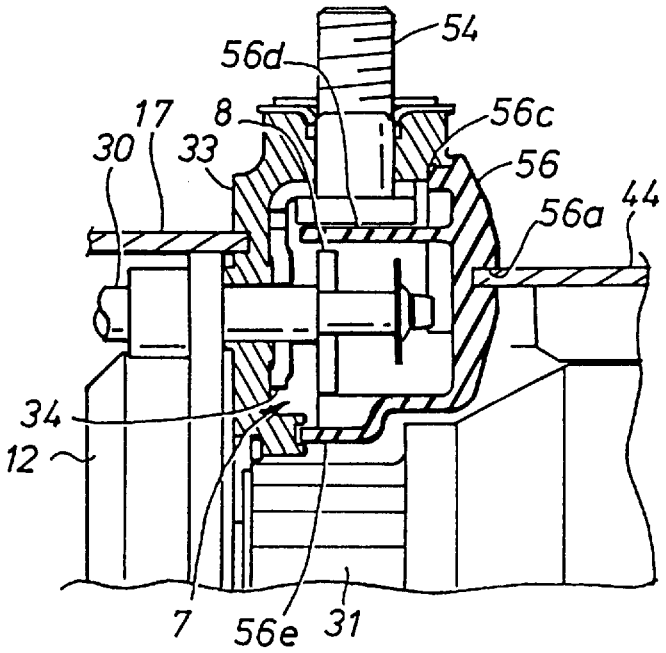
FIG. 4 is a side sectional view of essential parts for illustrating a second embodiment of the cover.
Figure 5:
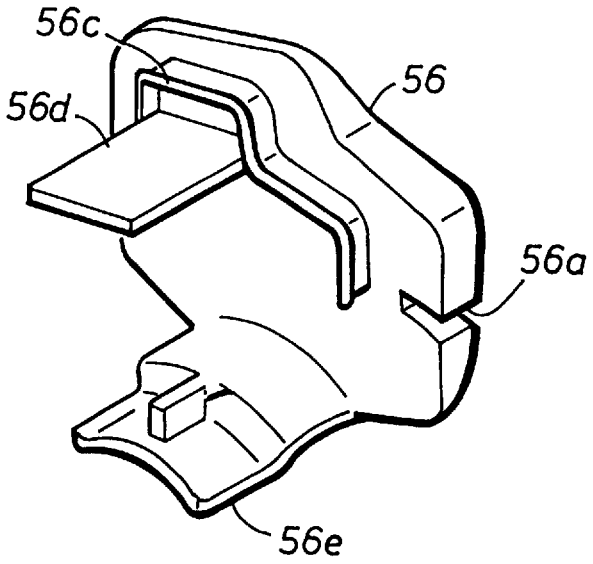
FIG. 5 is a perspective view of the second embodiment of the cover.

The shape of the cover should not be limited to the above embodiment, but the cover can be formed as shown in FIGS. 4 and 5. In these drawings, the parts similar to those shown in the above described embodiment are denoted with the same reference numerals, and the further description thereof is omitted.

The cover 56 shown in FIG. 4 also has a part for covering the cavity 55*a* of the brush holder stay 33 and this part for covering the cavity 55*a* is substantially the same as that of the above shown embodiment, but the cover 56 is formed with upper and lower axially projecting walls 56*d* and 56*e* on its side facing the brush holder stay 33, as also shown in FIG. 5. These projecting walls 56*d* and 56*e* cover the upper and lower sides of the contact unit of the switch unit 7 so that the prevention of water and/or dust from reaching the contact unit can be achieved even more effectively.

In the cover 56 shown in FIG. 5, the aforementioned axial protrusion is formed such that it extends substantially along the inner peripheral surface of the cavity 55*a*. Corresponding to the arcuate recess 45*a* and the ridges 45*b* and 45*c* of the embodiment shown in FIG. 1, the cover 56 is also provided with an arcuate recess 56*a* and a ridge 56*c* (the ridge in the arcuate recess 56*a* is not shown in the drawings) in a similar fashion, and the operation and effects of the cover 56 are substantially the same as those of the above illustrated embodiment.

Thus, according to the present invention, the cover for covering a cavity in the brush holder stay is formed such that it is naturally curved, and thus, when pressed against the brush holder stay by the motor casing to be brought into tight contact with the brush holder stay, the cover becomes straight to produce a resilient restoring force, whereby increasing the pressing force to ensure sufficient watertight sealing effect. This can tolerate less precision in making the cover and/or other component parts and therefore can lead to a reduced manufacturing cost. In addition to the axial force from the motor casing, the straightening action of the cover can produce a radial force, to thereby allow the cover to be pressed against the brush holder stay not only in the axial direction but also in the radial direction so that tighter contact therebetween can be achieved.

Although the present invention has been described in terms of preferred embodiments thereof, it is obvious to a person skilled in the art that various alterations and modifications are possible without departing from the scope of the present invention which is set forth in the appended claims. For example, the cover may be made without an axial protrusion shown above. When a stepped portion is formed along the brim of the cavity, the cover can be shaped such that when attached to the brush holder stay, the cover abuts a shoulder surface of the stepped portion and its outer peripheral surface closely faces an inner peripheral surface of the stepped portion. In this case also, the radial force produced by the straightening action of the cover works to achieve an enhanced radial engagement between the cover and the brush holder stay.

What we claim is:

1. A starter for an internal combustion engine, comprising:

a pinion;

shift means for moving the pinion into mesh with a ring gear of the engine;

a housing for accommodating the pinion and the shift means;

an electric motor for rotating the pinion;

a substantially cylindrical motor casing for accommodating the electric motor;

a contact unit for selectively providing electric power to the electric motor;

a brush holder stay disposed between the housing and the motor casing, the brush holder stay having a cavity opened toward the motor casing and the contact unit being mounted in the cavity; and a cover for covering the cavity of the brush holder stay, the cover being made of a flexible member so that the cover is naturally curved, wherein the cover is disposed between the brush holder stay and the motor casing with its concave surface facing the brush holder stay so as to be pushed against the brush holder stay by an axial end of the motor casing.

2. A starter for an internal combustion engine according to claim 1, wherein the cover for covering the cavity is provided with an axial protrusion on its surface facing the brush holder stay so that an outer peripheral surface of the axial protrusion of the cover closely faces the inner peripheral surface of the cavity.

3. A starter for an internal combustion engine according to claim 2, wherein the outer peripheral surface of the axial protrusion of the cover is provided with a ridge projecting toward the inner peripheral surface of the cavity.

4. A starter for an internal combustion engine according to claim 2, wherein the inner peripheral surface of the cavity is provided with a ridge projecting toward the outer peripheral surface of the axial protrusion of the cover.

5. A starter for an internal combustion engine according to claim 2, wherein a stepped portion is formed along a brim of the cavity and an end surface of the axial protrusion of the cover has a shape complementary to the stepped portion.

6. A starter for an internal combustion engine according to claim 1, wherein a stepped portion is formed along a brim of the cavity and the cover is shaped such that when attached to the brush holder stay, it abuts a shoulder surface of the stepped portion and its outer peripheral surface closely faces an inner peripheral surface of the stepped portion.

7. A starter for an internal combustion engine according to claim 1, wherein the cover is provided on its surface facing the brush holder stay with at least one axially projecting walls for protecting the contact unit.

8. A starter for an internal combustion engine according to claim 7, wherein said at least one axially projecting walls of the cover consist of upper and lower projecting walls extending on upper and lower sides of the contact unit in an assembled state.

9. A starter for an internal combustion engine according to claim 1, wherein a surface of the cover which is pushed by the motor casing is formed with an arcuate recess adapted for receiving the axial end of the motor casing.

10. A starter for an internal combustion engine according to claim 8, wherein a bottom of the arcuate recess of the cover is provided with a ridge projecting toward the motor casing.

11. A starter for an internal combustion engine according to claim 1, wherein the brush holder stay is formed with a protruding portion which extends in a radially outward direction with respect to the motor casing in order to mount a power supply terminal for connection to an outside power supply, and said cavity extends to at least a part of the protruding portion of the brush holder stay.

* * * * *